US005498065A

United States Patent [19]

Tosoni

[11] Patent Number: 5,498,065

[45] Date of Patent: Mar. 12, 1996

[54] OFFICE ARMCHAIR BODY WHICH CAN BE DISMANTLED

[75] Inventor: Isidoro Tosoni, Manzano, Italy

[73] Assignee: Effezeta Srl, Italy

[21] Appl. No.: 248,722

[22] Filed: May 25, 1994

[30] Foreign Application Priority Data

Jun. 28, 1993 [IT] Italy ..... UD93A0123

[51] Int. Cl.[6] ..... A47C 7/00

[52] U.S. Cl. ..... 297/440.21; 297/411.41; 297/440.16

[58] Field of Search ..... 297/440.21, 229, 297/440.13, 440.16, 440.1, 411.41

[56] References Cited

U.S. PATENT DOCUMENTS

| | | | |
|---|---|---|---|
| 1,256,726 | 2/1918 | Pike | 297/411.41 |
| 3,471,199 | 10/1969 | Kuhlmann . | |
| 4,003,600 | 1/1977 | Horn . | |
| 4,123,105 | 10/1978 | Frey et al. . | |
| 5,088,792 | 2/1992 | Guichon . | |

FOREIGN PATENT DOCUMENTS

| | | | |
|---|---|---|---|
| 1239576 | 7/1988 | Canada | 297/440.16 |
| 2534792 | 10/1982 | France . | |
| 490663 | 5/1955 | Italy | 297/411.41 |
| 29067 | 12/1911 | United Kingdom | 297/416 |
| 2040159 | 8/1980 | United Kingdom | 297/440.13 |

*Primary Examiner*—Laurie K. Cranmer
*Attorney, Agent, or Firm*—Breiner & Breiner

[57] ABSTRACT

An armchair body which can be dismantled composed of (1) a first one-piece rigid plastic unit including a base serving as a seat, a base of a seatback extending upward from the seat, and two opposed arms extending upward from the seat, and (2) a second one-piece unit which serves as an upper part of the seatback and which is detachably attachable to the first one-piece unit. The base of the seatback and the two arms at their upper surface are present substantially in a common plane. This upper surface contains therein integral alignment and anchorage elements structured to cooperate with mating alignment and anchorage elements present as an integral part of the lower portion of the second one-piece unit. When the alignment and anchorage elements of the first unit are joined with the alignment and anchorage elements of the second unit, the front surface of the base of the seatback of the first unit and the front surface of the upper part of the seatback of the second unit create a substantially vertical continuous region. Replaceable cushions can be readily fit to this continuous region to provide a second continuous surface.

12 Claims, 3 Drawing Sheets

OFFICE ARMCHAIR BODY WHICH CAN BE DISMANTLED

This invention concerns an office armchair body which can be dismantled, as set forth in the main claim.

The office armchair body which can be dismantled is applied advantageously to the provision of office armchairs and, in particular, to office armchairs with stationary lateral arms and with a seatback of a low or high type, that it to say, a type for visitors and a type for managers.

The body which can be dismantled according to the invention is employed for the provision of armchairs in which the seatback and seat are fixed to each other and cannot be adjusted in relation to each other.

The body which can be dismantled according to the invention can be used to make armchairs provided with known systems for adjusting the height .of the seat and for oscillatory adjustment, which enables the inclination of the body to be adjusted in two or more different positions.

The body according to the invention can be employed equally well in rotatable arm chairs possibly equipped with casters at their lower end and in stationary armchairs.

Office armchairs with a high or low seatback and lateral arms are well known. These armchairs have a body which forms the seatback and seat and is normally made of bent lamellar wood.

This body is generally upholstered and includes cushions to sit on and rest against, which are made of soft foam material such as foam rubber, for instance, covered with a finishing material such as leather, leathercloth, artificial leather or a woven fabric.

One of the greatest problems linked to this type of armchair is due to the tearing or breaking of the covering material, above all at the points where the material is folded or at the rear of the seatback.

In fact, it often happens that the armchair is scraped against the desk or that some jutting object comes into contact with the rear of the seatback and thus spoils the armchair to the extent of making necessary the replacement of a part or of the upholstery of the damaged part with great annoyance and high costs for its user.

Next, this type of armchair includes arms, which are advantageously L-shaped and are secured to the body with screws partly in the seat and partly in the seatback zone.

Suitable upholstered cushions are then applied, fixedly or removably to the body thus covered, on the seat and on the seatback.

This type of armchair is widely used nowadays, and a plurality of manufacturers are competing on the market and have reached the limit of their .ability in seeking a reduction in their production and transport costs in an effort to retain at least a share of this market.

With a view to reducing transport costs armchairs have been offered in which the body is made in two separate parts, namely the seatback and seat.

So as to assist assembly and transport, the arms of these models are secured to the seat and seatback with screws; the screws associated with the seatback act as a pivot of rotation of the seatback to the transport position of the armchairs.

In the usage position of the armchairs appropriate hooks, which can be momentarily put in position, clamp the seat of the body to the seatback of the body firmly in the correct position.

Instead, in the transport position the clamping hooks are disengaged and the seatback is rotated about the connecting screws associated with the arms until it is folded in a position substantially parallel to the seat, thus lessening greatly the overall bulk of the armchair.

But this transport position entails the shortcoming that the impacts and stresses which the seatback may undergo during storage and transport are wholly discharged onto the rotation pivots or the screws which secure the arms to the seat. These stresses may cause deformation and/or breakage of the connecting screws or of the arms themselves.

Moreover, this solution involves the drawback of requiring manual assembly work in the factory to assemble the seat with the seatback and arms and also a series of accessories such as screws, bolts, etc. which increase the production costs of the armchair.

Furthermore, the armchairs require assembly work by the end user too before the armchairs can be used.

This fact may create great annoyance for the buyer and may lead to damage of part of the armchair or to wrong assembly of the same with a resulting loss of time and discomfort.

Besides, with the armchairs of the state of the art it is impossible to convert an armchair with a low seatback into an armchair with a tall seatback, or viceversa, unless the seatback itself is completely replaced.

The prior art document EP-A-0385838 shows a plastic garden armchair complete with legs, seatback and arms and made in one piece, the arms and the seatback being positioned on different planes; the ability to stack the chairs is due to cooperation of empty spaces with solid portions, so that the legs can be inserted into empty spaces.

This document does not teach how to produce an armchair which overcomes the shortcomings mentioned above.

The prior art document U.S. Pat. No. 3,471,199 discloses an armchair with a basic body and an upper covering consisting of the arms and seatback. This upper covering extends forwards so as to hide the basic body. This document does not give any useful solution for overcoming the above shortcomings, even in combination with other documents.

The present applicants have designed, tested and embodied this invention to overcome the shortcomings of the state of the art and to achieve further advantages.

This invention is set forth and characterised in the main claim, while the dependent claims describe variants of the idea of the main embodiment.

The purpose of the invention is to provide an armchair body which can be dismantled, the body being suitable to form armchairs having a low or high seatback and being of the type employed in offices; the body should be simple to construct and should reduce considerably the production and transport costs.

The body which can be dismantled according to the invention comprises a first unit made of a substantially rigid plastic material advantageously having a black colour and a good surface finish and therefore not requiring a surface covering.

A replaceable part of the seatback cooperates with the first unit, which constitutes the seat, a part of the seatback and the advantageously L-shaped arms in one single structure.

The replaceable part of the seatback forms a second unit which has a low height for low armchairs and a tall height for high armchairs of a type intended for managers. This second unit is associated with the first unit to create a vertical whole.

Such association is achieved with male/female alignment and mutual anchorage means.

According to a variant resilient male means are included which are anchored in female means in the first unit.

The first unit and second unit are completed with seat and seatback cushions of a known type in their front part.

In the transport position the second unit is dismantled and placed within the first unit above the seat, thus reducing the overall bulk and transport costs and preventing the possibility of impacts damaging the armchairs.

If the chair is stored or despatched together with the cushions, the cushions are placed between the seat of the first unit and the second unit and are thus covered and protected.

The padded and suitably shaped cushions are secured to the first and second units by means of momentary fixture means consisting, for instance, of pressure-sensitive adhesive tape, straps, buttons, pins or other analogous means.

The first unit includes on the bottom of the seat a raised surface extending substantially over the whole seat; this raised surface enables the stiffening ribs and the attachment for the armchair supporting means to be contained below the surface and to be hidden.

In fact, this raised surface makes possible the provision of zones of a greater thickness in the lower and substantially central part of the seat at the points where the supports of the seat are anchored.

Besides, this raised surface, by creating a hollow which surrounds it, enables the frame and circumferential borders of the cushion to be accommodated without causing deformations or excessive wear while facilitating the engagement of the cushion at the same time.

The raised surface on the bottom of the seat also includes a perimetric hollow which assists application of the cushion and improves the sitting position.

Moreover, the first unit includes advantageously a rib around the whole perimeter of the seat and seatback; this rib has aesthetic and also functional purposes and not only provides strengthening and stiffening but also provides the space and base required for attachment of the second unit and strengthens the seatback zone where the pressure applied by the person seated is normally great.

Furthermore, in the body which can be dismantled according to the invention further reinforcing and stiffening means are associated advantageously with the means which align and clamp the second unit to the low seatback of the first unit.

Both the first and second units include at their two sides means to retain the cushions; these means to retain the cushions consist of a suitably bent and jutting lateral edge.

These cushion retaining means not only create a strengthening of the second unit and provide the second unit with an aesthetic feature but also act to support the cushion laterally and to resist any lateral thrust when a user sits down off-centre.

The arms in the first unit lie advantageously on the same plane as the upper rear edge of the first unit so as to create a single plane to assist storage operations and reduce the overall bulk.

Moreover, so as to strengthen the arms and provide a characterizing aesthetic feature, the front segment of the arms extends downwards to be connected to the lower edge of the seat; a plurality of ribs are included advantageously and have an aesthetic function besides strengthening the arms.

Furthermore, the flat part of the arms substantially parallel to the body of the first unit is reinforced with strengthening ribs.

The attached figures are given as a non-restrictive example and show a preferred embodiment of the invention as follows:

FIGS. 1*a* and 1*b* are three-dimensional drawings of the two units forming the body which can be dismantled according to the invention in their non-assembled position;

Figure 1A:
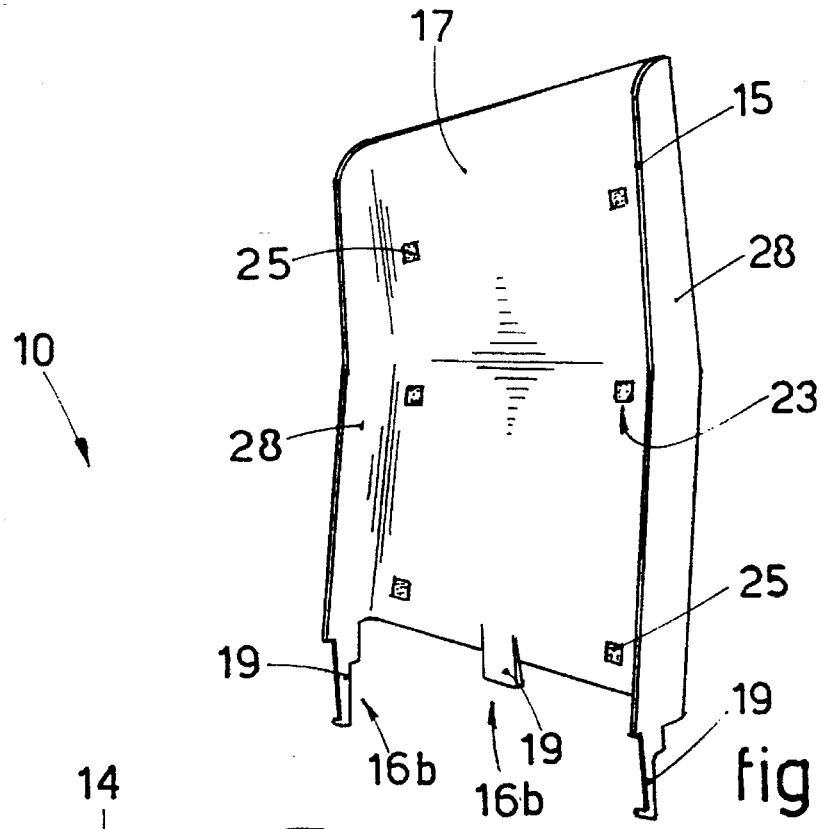
Figure 1B:
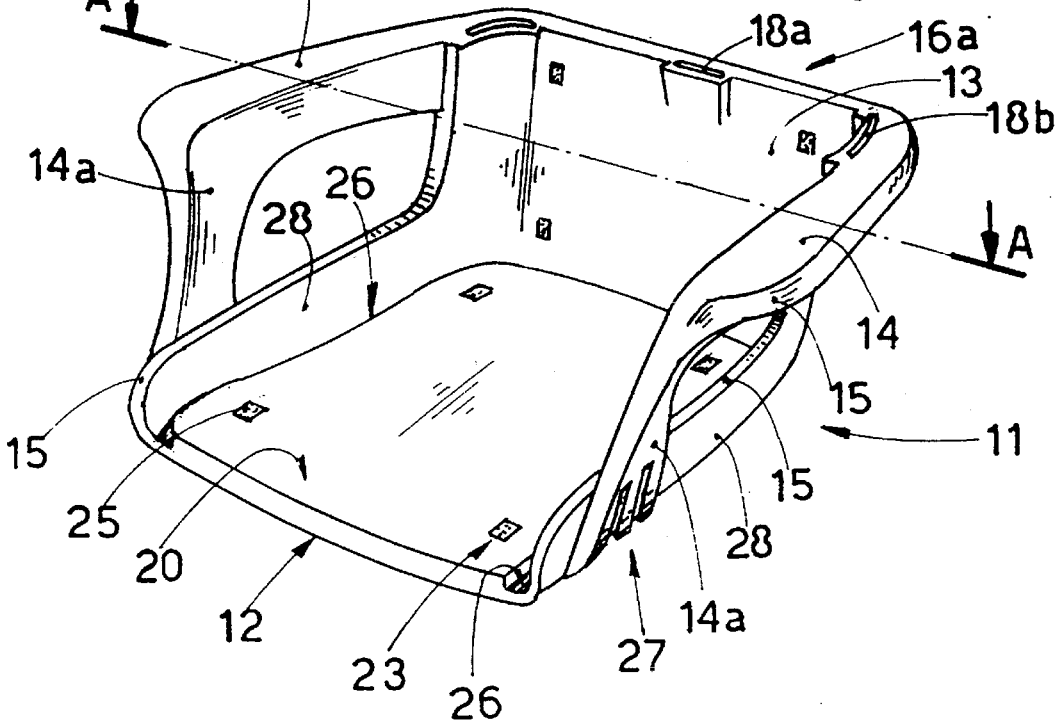
Figure 2:
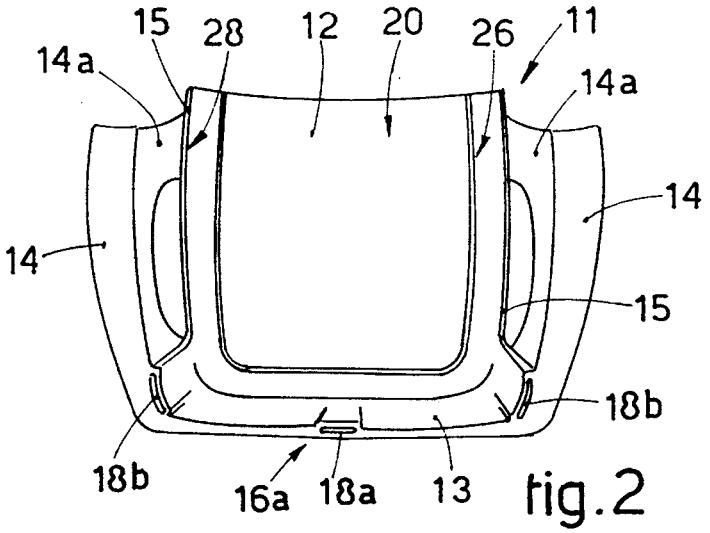
FIG. 2 is a plan view of the first unit forming the body of FIG. 1 according to the invention.
Figure 3:
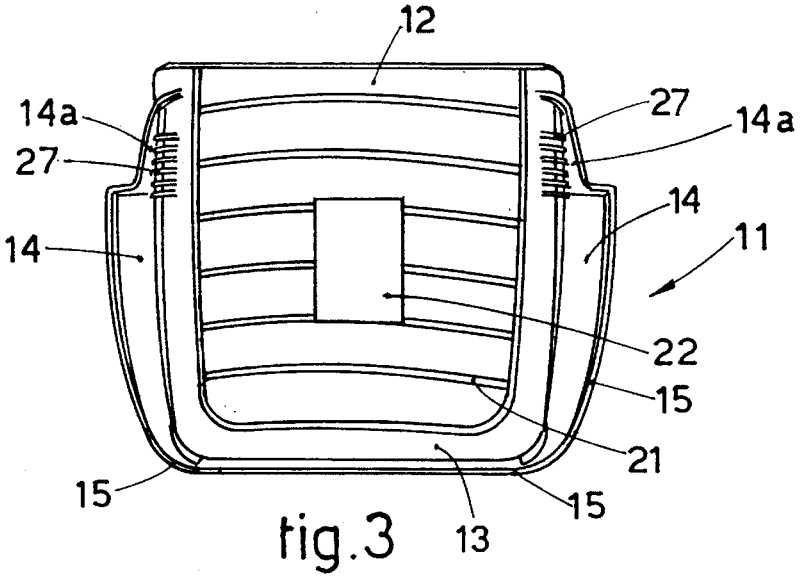
FIG. 3 is a view from below of the first unit of the body of FIG. 2.
Figure 4A:
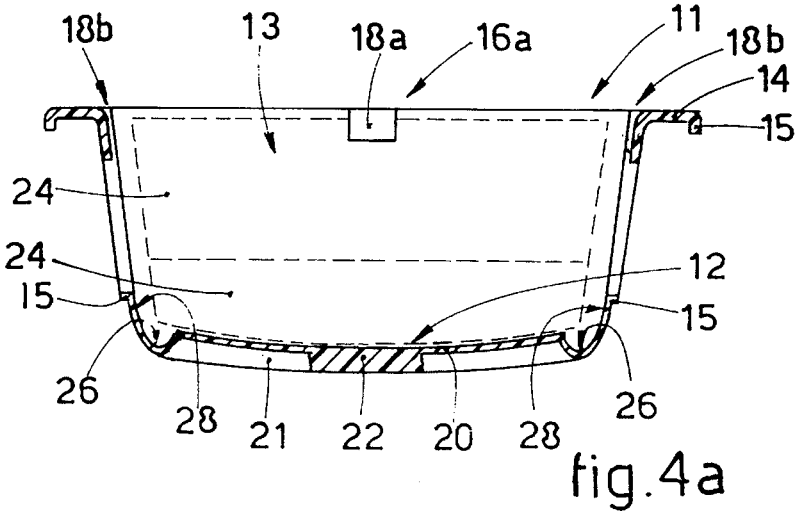

FIG. 4*a* shows a cross-section along the line A—A of the first unit of FIG. 1*b*, in which the cushions are indicated with lines of dashes.

Figure 5:
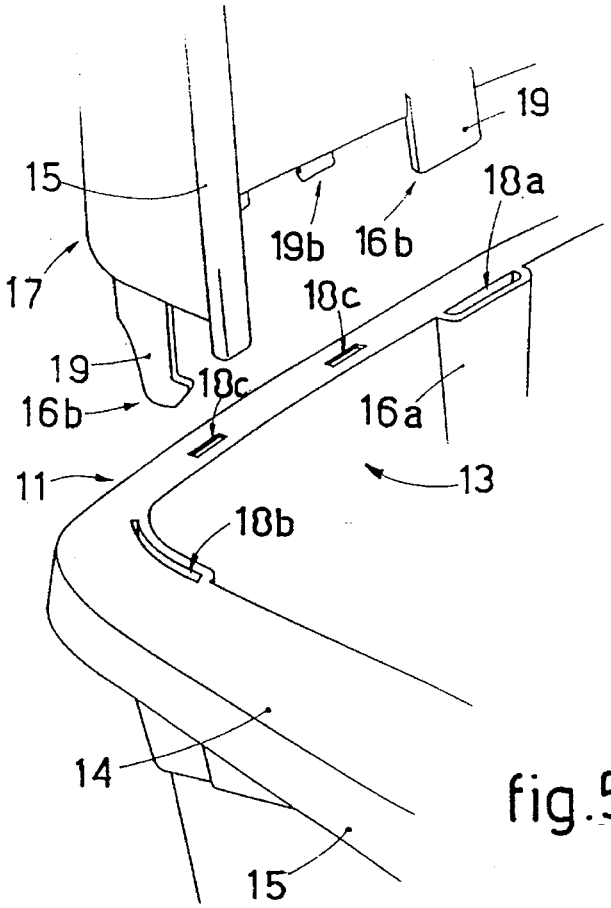
Figure 4B:
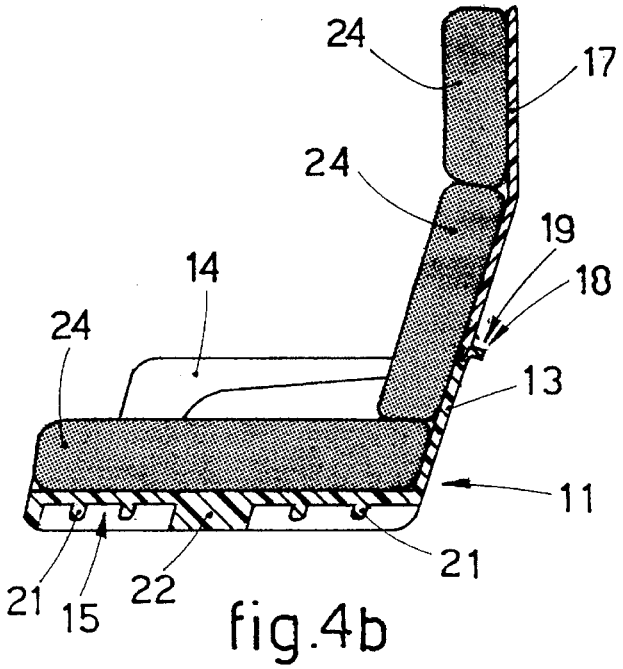

FIG. 4*b* shows a vertical section of the body which can be dismantled according to the invention, as shown in FIG. 1, and to which the cushions are fitted;

FIG. 5 shows a variant of the means that connect the first unit to the second unit.

The reference number 10 in the attached figures denotes generally a body which can be dismantled according to the invention.

The body 10 which can be dismantled according to the invention comprises a first unit 11 consisting of a seat 12, a base of a seatback 13 and arms 14; this first unit 11 can be associated momentarily with a second unit 17 so as to constitute an armchair.

The second unit 17 is associated with the first unit 11 at the base of the low seatback 13 so as to form a vertical continuous structure.

This second unit 17 can be replaced and will possess a low height for armchairs with a low seatback of the type for use by visitors, for instance, or a tall height for armchairs with a tall seatback for use by managers, for instance as shown in the attached figures.

The arms 14 are advantageously shaped as an overturned "L" and advantageously positioned on the same plane as the rear upper edge forming the base of the seatback 13 of the first unit 11 so as to create continuity of surface and assist storage and optimise the packing of these bodies 10.

This surface defined by the seatback 13 and arms 14 is advantageously substantially parallel to the lower surface of the first unit 11, as can be seen in FIG. 4*b*.

The first unit 11 and second unit 17 are made of a rigid plastic material with its outer surface possessing a good finish and advantageously, but not necessarily, of a black colour.

Both the first 11 and second 17 units include at their two sides wing means 28 to retain laterally cushions 24 which can be fitted to the body 10 according to the invention and can be replaced; these retaining wing means 28 are formed as a continuation of a curved and jutting edge of the seat 12 of the first unit 11 and of the seatback zone of the second unit 17.

Both the first 11 and second 17 units forming the body 10 according to the invention comprise advantageously reinforcing means 15, which extend at least along a part of the respective perimeters to provide enough rigidity and strength for the body 10 to withstand the stresses generated by the user of the armchairs and also to improve use of the product.

Moreover, the first unit 11 comprises in the upper part of the seat 12 alignment and anchorage means 16a, of a female type in this case, with which there cooperate mating alignment and anchorage means 16b, of a male type in this case, included in the lower part of the second unit 17 which cooperates with the first unit 11 in forming an armchair with a low or tall seatback, depending on the type of the second unit 17 employed.

In this example the alignment and anchorage means 16*a* of a female type include three slots 18, namely a central slot 18*a* and two lateral slots 18*b* respectively, with which there cooperate protrusions 19 suitably conformed, for instance as hooks, which constitute the mating alignment and anchorage means 16*b* of a male type.

According to a variant the slots 18 are hollowed in a further strengthening and stiffening element of the base of the seatback 13, this element consisting, for instance, of a strip which extends along the whole outer upper edge of the first unit 11.

According to the variant of FIG. 5 further anchorage and alignment means 18*c* and 19*b* are included and create a connection inverted as compared to the other alignment and anchorage means so as to make the connection safer and more stable.

So as to strengthen the arms 14, the front segment 14*a* of the same extends downwards to the lower edge of the seat 12 to form a plurality of ribs 27 which perform an aesthetic function besides stiffening the body 10.

The bottom of the seat 12 of the first unit 11 comprises advantageously a raised surface 20, which extends substantially over the whole surface of the bottom and defines a perimetric groove 26.

The raised surface 20 contains on its lower side a plurality of reinforcement ribs 21 positioned parallel to each other or advantageously intersecting each other on the lower face of the seat 12 so as to strengthen the seat 12.

The seat 12 includes also on its lower face in a substantially central position at least one zone of an increased thickness 22, to which are secured, by screw systems for instance, the supports that uphold the armchair.

Both the first 11 and second 17 units comprise advantageously means 23 for momentary fixture of padded cushions 24, which are upholstered as desired and associated with the body 10 according to the invention.

In this case the momentary fixture means 23 consist of pressure-sensitive adhesive tape portions 25 arranged in mating positions on the respective first 11 and second 17 units and on the hidden surface of the cushions 24.

According to a variant which is not shown, the momentary fixture means 23 consist of buttons, straps, pins or other analogous means.

In the transport position the second unit 17 is disengaged from the first unit 11 and is placed substantially parallel to and above the seat 12, thus lessening considerably the space taken up and reducing sharply the costs of storage and transport of the body 10.

I claim:

1. An armchair body which can be readily assembled or dismantled comprising (1) a first one-piece rigid plastic unit comprising a base serving as a seat, an upstanding rear portion serving as a base of a seatback, and first and second upstanding side portions each serving as an arm, wherein a top surface of the base of the seatback and a top surface of each arm are continuous with respect to each other and are substantially present in a common plane, and wherein a plurality of aligning and anchoring means are integrally present in the top surface of the base of the seatback and/or the top surface of each arm, and (2) a second one-piece unit removably attached to said first one-piece unit at least the top surface of said base of the seatback, said second one-piece unit comprising an upper part of a seatback complementary to the base of the seatback so as to provide a continuous substantially vertical surface when the first one-piece unit is attached to said second one-piece unit, wherein the second one-piece unit has a bottom surface with a plurality of aligning and anchoring means integral therewith and having a mating structure to the plurality of aligning and anchoring means of said first one-piece unit so as to anchor said second one-piece unit to said first one-piece unit in absence of separate hardware components when the first one-piece unit is connected to said second one-piece unit, wherein when said plurality of aligning and anchoring means of said second one-piece unit are matingly joined with said plurality of aligning and anchoring means of said first one-piece unit, said base of the seatback and the upper part of the seatback are joined in a continuous manner to provide a unitary seatback without gaps between the first one-piece unit and the second one-piece unit, and wherein the second one-piece unit is of a size so that when said second one-piece unit is detached from said first one-piece unit, said second one-piece unit is able to at least in part lie substantially flat upon the seat of the first one-piece unit while lying below the top surface of said base of the seatback and the top surface of each arm thereby allowing for ease in transport and storage of the first one-piece unit and the second one-piece unit.

2. Armchair body according to claim 1 wherein said second one-piece unit can be of various heights.

3. Armchair body according to claim 1 wherein said second one-piece unit further comprises longitudinally extending side extensions structured and arranged for retaining a cushion on a front surface of said upper part of the seatback.

4. Armchair body according to claim 1 wherein each arm is L-shaped, and at a first end each arm is connected to said base of the seatback and at a second end each arm is connected to said seat.

5. Armchair body according to claim 4 wherein said second end comprises a plurality of reinforcement ribs.

6. Armchair body according to claim 1 wherein said plurality of aligning and anchoring means of said first one-piece unit are slots and said plurality of aligning and anchoring means of said second one-piece unit are projections insertable in said slots.

7. Armchair body according to claim 1 wherein said plurality of aligning and anchoring means of said second one-piece unit are slots and said plurality of aligning and anchoring means of said first one-piece unit are projections insertable in said slots.

8. Armchair body according to claim 1 wherein said base serving as a seat of said first one-piece unit includes an upraised area over at least a portion of an upper face of the base.

9. Armchair body according to claim 8 wherein a perimetric groove surrounds said upraised surface.

10. Armchair body according to claim 1 wherein said base serving as a seat includes a plurality of reinforcement ribs in an underside face of the base.

11. Armchair body according to claim 1 wherein at least one cushion is affixed to said seat, the base of the seatback, and the upper part of the seatback to provide a continuous surface on said armchair body.

12. Armchair body according to claim 1 wherein said base serving as a seat includes on an underside face at least a central zone of increased thickness.

* * * * *